US011581637B2

(12) United States Patent
Ameer P et al.

(10) Patent No.: US 11,581,637 B2
(45) Date of Patent: Feb. 14, 2023

(54) ADJUSTABLE REFLECTOR ANTENNAS

(71) Applicant: CommScope Technologies LLC, Hickory, NC (US)

(72) Inventors: Muhammed Ameer P, Kerala (IN); Shital Udagave, Maharashtra (IN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/477,312

(22) Filed: Sep. 16, 2021

(65) Prior Publication Data

US 2022/0094051 A1 Mar. 24, 2022

Related U.S. Application Data

(60) Provisional application No. 63/081,074, filed on Sep. 21, 2020.

(51) Int. Cl.

| | |
|---|---|
| ***H01Q 3/16*** | (2006.01) |
| ***H01Q 3/06*** | (2006.01) |
| ***H01Q 21/26*** | (2006.01) |
| ***H01Q 1/42*** | (2006.01) |
| ***H01Q 1/24*** | (2006.01) |

(Continued)

(52) U.S. Cl.

CPC ..... *H01Q 3/16* (2013.01); *H01Q 1/246* (2013.01); *H01Q 1/42* (2013.01); *H01Q 3/01* (2013.01); *H01Q 3/06* (2013.01); *H01Q 5/42* (2015.01); *H01Q 21/26* (2013.01)

(58) Field of Classification Search

CPC ..... H01Q 1/246; H01Q 3/01; H01Q 3/16; H01Q 3/02; H01Q 3/04; H01Q 3/06; H01Q 3/08; H01Q 3/10; H01Q 3/12; H01Q 3/14; H01Q 3/18; H01Q 3/20; H01Q 21/26;

(Continued)

(56) References Cited

U.S. PATENT DOCUMENTS 5,469,181 A * 11/1995 Yarsunas ..... H01Q 3/20 343/820
7,015,871 B2 * 3/2006 Gotti ..... H01Q 1/246 343/882

(Continued)

FOREIGN PATENT DOCUMENTS

CN 109216914 A * 1/2019 ..... H01Q 1/246
WO WO-2006065172 A1 * 6/2006 ..... H01Q 1/246
WO WO-2020258029 A1 * 12/2020 ..... H01Q 1/246

*Primary Examiner* — Ab Salam Alkassim, Jr.
*Assistant Examiner* — Anh N Ho
(74) *Attorney, Agent, or Firm* — Myers Bigel, P.A.

(57) ABSTRACT

A base station antenna includes first and second reflectors that are movable relative to each other, and each of the first and second reflectors includes a plurality of radiating elements on a main reflector surface thereof. A third reflector is movably coupled to the first and second reflectors, and movement of the third reflector causes the first and second reflectors to move relative to each other. A drive mechanism is utilized to move the third reflector and includes a drive shaft, an actuator configured to rotate the drive shaft, and a threaded shaft coupled to the drive shaft and configured to rotate in response to rotation of the drive shaft. Rotational movement of the threaded shaft causes linear movement of the third reflector. A control unit, such as a remote electrical tilt (RET) controller controls the actuator to rotate the driveshaft.

19 Claims, 19 Drawing Sheets

(51) Int. Cl.
*H01Q 3/01* (2006.01)
*H01Q 5/42* (2015.01)

(58) Field of Classification Search
CPC .... H01Q 21/08; H01Q 21/062; H01Q 19/108; H01Q 19/18; H01Q 19/185
See application file for complete search history.

(56) References Cited

U.S. PATENT DOCUMENTS

| | | | | |
|---|---|---|---|---|
| 7,492,322 | B2 * | 2/2009 | Jung | H01Q 21/065 343/882 |
| 8,743,008 | B2 * | 6/2014 | Kim | H01Q 3/06 343/882 |
| 11,264,727 | B2 * | 3/2022 | Zimmerman | H01Q 21/20 |
| 2007/0262911 | A1 * | 11/2007 | Kim | H01Q 3/20 343/757 |
| 2009/0021437 | A1 * | 1/2009 | Foo | H01Q 1/246 343/836 |
| 2009/0312057 | A1 * | 12/2009 | Moon | H01Q 1/246 455/562.1 |
| 2015/0244068 | A1 * | 8/2015 | Deng | H01Q 21/22 343/758 |
| 2021/0029556 | A1 * | 1/2021 | Wu | H01Q 15/14 |
| 2022/0013886 | A1 * | 1/2022 | Sczesny | H01Q 1/1207 |

* cited by examiner

ADJUSTABLE REFLECTOR ANTENNAS

RELATED APPLICATION

This application claims the benefit of and priority to U.S. Provisional Patent Application No. 63/081,074 filed Sep. 21, 2020, the disclosure of which is incorporated herein by reference as if set forth in its entirety.

FIELD

The present invention relates generally to communications systems and, more particularly, to antennas that are suitable for use in cellular communications systems.

BACKGROUND

Cellular communications systems are well known in the art. In a typical cellular communications system, a geographic area is divided into a series of regions that are referred to as "cells," and each cell is served by a base station. The base station may include baseband equipment, radios and base station antennas that are configured to provide two-way radio frequency ("RF") communications with subscribers that are positioned throughout the cell. In many cases, the cell may be divided into a plurality of "sectors," and separate base station antennas provide coverage to each of the sectors. The antennas are often mounted on a tower or other raised structure, with the radiation beam ("antenna beam") that is generated by each antenna directed outwardly to serve a respective sector. Typically, a base station antenna includes one or more phase-controlled arrays of radiating elements, with the radiating elements arranged in one or more vertical columns when the antenna is mounted for use. Herein, "vertical" refers to a direction that is perpendicular relative to the plane defined by the horizon. Reference will also be made to the azimuth plane, which is a horizontal plane that bisects the base station antenna, and to the elevation plane, which is a plane extending along the boresight pointing direction of the antenna that is perpendicular to the azimuth plane.

A common base station configuration is a "three sector" configuration in which the cell is divided into three 120° sectors in the azimuth plane. A base station antenna is provided for each sector. In a three sector configuration, the antenna beams generated by each base station antenna typically have a Half Power Beam Width ("HPBW") in the azimuth plane of about 65° so that the antenna beams provide good coverage throughout a 120° sector. Three such base station antennas provide full 360° coverage in the azimuth plane. Typically, each base station antenna will include one or more so-called "linear arrays" of radiating elements that includes a plurality of radiating elements that are arranged in a generally vertically-extending column. In many cases, the base station antenna may be a so-called "multi-band" antenna that includes different arrays of radiating elements that operate in different frequency bands.

Sector-splitting refers to a technique where the coverage area for a base station is divided into more than three sectors in the azimuth plane, such as six, nine or even twelve sectors. A six-sector base station will have six 60° sectors in the azimuth plane. Splitting each 120° sector into two sub-sectors increases system capacity because each antenna beam provides coverage to a smaller area, and therefore can provide higher antenna gain and/or allow for frequency reuse within a 120° sector. In six-sector sector-splitting applications, a single twin beam antenna is typically used for each 120° sector. The twin beam antenna generates separate antenna beams that each have a reduced size in the azimuth plane (typically about half the size of a normal sector antenna beam) and that each point in different directions in the azimuth plane (typically about −30° and 30° from the boresight pointing direction of the antenna) for at least one frequency band, thereby splitting the sector into two smaller sub-sectors. Several approaches have been used to implement such twin beam antennas. In one approach, several linear arrays of radiating elements may be mounted on each panel of a V-shaped reflector. By providing multiple columns of radiating elements, the width of the antenna beams in the azimuth plane can be narrowed. Unfortunately, adjusting the configuration of such V-shaped reflectors can be difficult.

SUMMARY

Pursuant to some embodiments of the present invention, a base station antenna includes first and second reflectors that are movable relative to each other, wherein each of the first and second reflectors includes a plurality of radiating elements on a main reflector surface thereof. A third reflector is movably coupled to the first and second reflectors, and movement of the third reflector causes the first and second reflectors to move relative to each other. A drive mechanism is utilized to move the third reflector, and thereby the first and second reflectors. In some embodiments, the drive mechanism includes a drive shaft, an actuator configured to rotate the drive shaft, and a threaded shaft coupled to the drive shaft and configured to rotate in response to rotation of the drive shaft. The threaded shaft is threadably coupled to the third reflector such that rotational movement of the threaded shaft causes linear movement of the third reflector. A control unit, such as a remote electrical tilt (RET) controller associated with the base station antenna may be utilized to control the actuator.

In some embodiments, the third reflector includes a threaded nut that engages the threaded shaft of the drive mechanism. The threaded nut is configured to move along the threaded shaft during rotation of the threaded shaft providing the linear movement of the third reflector.

In some embodiments, the plurality of radiating elements on each of the first and second reflectors include at least one column of radiating elements. In some embodiments, the at least one column of radiating elements includes three columns of radiating elements, wherein at least one of the three columns of radiating elements is staggered with respect to another one of the three columns of radiating elements.

According to other embodiments of the present invention, a base station antenna includes a reflector assembly having first and second reflectors that are movable relative to each other, each of the first and second reflectors comprising a plurality of radiating elements on a main reflector surface thereof, and a drive mechanism configured to move the first and second reflectors relative to each other. The reflector assembly also includes a pair of first and second elongate members in spaced-apart relationship. The first reflector is pivotably mounted to the first elongate member along a first edge portion of the first reflector, and the second reflector is pivotably mounted to the second elongate member along a first edge portion of the second reflector. A third reflector is located proximate to the first and second reflectors and includes a first arm in slidable engagement with a guide slot associated with the first reflector and a second arm in slidable engagement with a guide slot associated with the second reflector. The drive mechanism is configured to move the third reflector such that the first and second arms move along the respective guide slots to cause pivotal movement of the first and second reflectors.

In some embodiments, the drive mechanism includes a drive shaft, an actuator configured to rotate the drive shaft, and a threaded shaft coupled to the drive shaft and configured to rotate in response to rotation of the drive shaft. The threaded shaft is threadably coupled to the third reflector such that rotational movement of the threaded shaft causes linear movement of the third reflector. A control unit, such as an RET controller, is configured to control the actuator.

In some embodiments, a frame is secured to and extends between the first and second elongate members. The drive shaft and threaded shaft are supported by the frame.

According to other embodiments of the present invention, a base station antenna includes a reflector assembly having a pair of first and second elongate RF chokes in spaced-apart relationship. A first reflector is pivotably mounted to the first elongate RF choke along a first edge portion of the first reflector, and a second reflector is pivotably mounted to the second elongate RF choke along a first edge portion of the second reflector. Each of the first and second reflectors includes a plurality of radiating elements on a main reflector surface thereof. The reflector assembly further includes a third reflector that is movably coupled to the first and second reflectors. Movement of the third reflector via a drive mechanism causes the first and second reflectors to move relative to each other.

In some embodiments, the third reflector includes a first arm in slidable engagement with a guide slot of a first rail attached to the first reflector, and a second arm in slidable engagement with a guide slot of a second rail attached to the second reflector. The drive mechanism is configured to move the third reflector such that the first and second arms move along the respective slots of the first and second rails to cause pivotal movement of the first and second reflectors. In some embodiments, the first and second rails are attached to the main reflector surface of the first and second reflectors. In other embodiments, the first and second rails are attached to a rear surface of the first and second reflectors.

In some embodiments, the drive mechanism includes a drive shaft, an actuator configured to rotate the drive shaft, and a threaded shaft coupled to the drive shaft and configured to rotate in response to rotation of the drive shaft. The threaded shaft is threadably coupled to the third reflector such that rotational movement of the threaded shaft causes linear movement of the third reflector. For example, in some embodiments, the third reflector includes a threaded nut that engages the threaded shaft, and the threaded nut is configured to move along the threaded shaft during rotation of the threaded shaft providing the linear movement of the third reflector. A control unit, such as an RET controller, is configured to control the actuator. In some embodiments, a frame is secured to and extends between the first and second elongate RF chokes, and the drive shaft is supported by the frame.

According to other embodiments of the present invention, an endcap configured to cover a bottom opening of a base station antenna randome includes a planar section having a plurality of support members extending therefrom in spaced apart relationship. Each support member has a distal end portion that is configured to engage a respective slot within a reflector of the base station antenna. In some embodiments, each of the support members has a hook-type configuration. In some embodiments the support members are integrally formed with the endcap. Various numbers of support members may be utilized. For example, in some embodiments, there are at least three support members, at least five support members, at least seven support members, etc. The endcap may further include at least one fixture configured to secure the reflector to the endcap via a threaded bolt and mount.

It is noted that aspects of the invention described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail below.

BRIEF DESCRIPTION OF THE DRAWINGS

The accompanying drawings, which form a part of the specification, illustrate various embodiments of the present invention. The drawings and description together serve to fully explain embodiments of the present invention.

DETAILED DESCRIPTION

Figure 1:
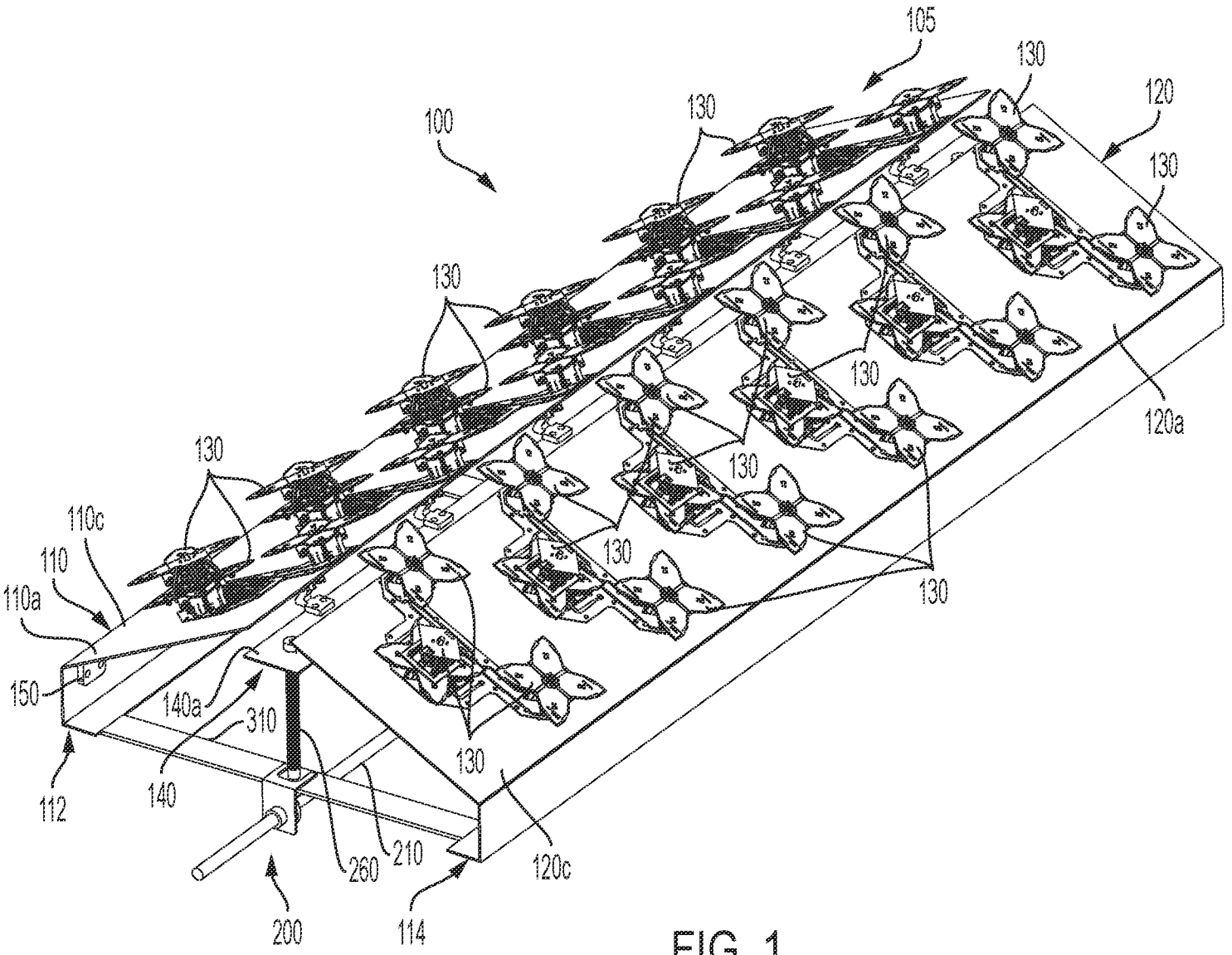
FIG. 1 is a front perspective view of selected components of a base station antenna according to some embodiments of the present invention.
Figure 2:
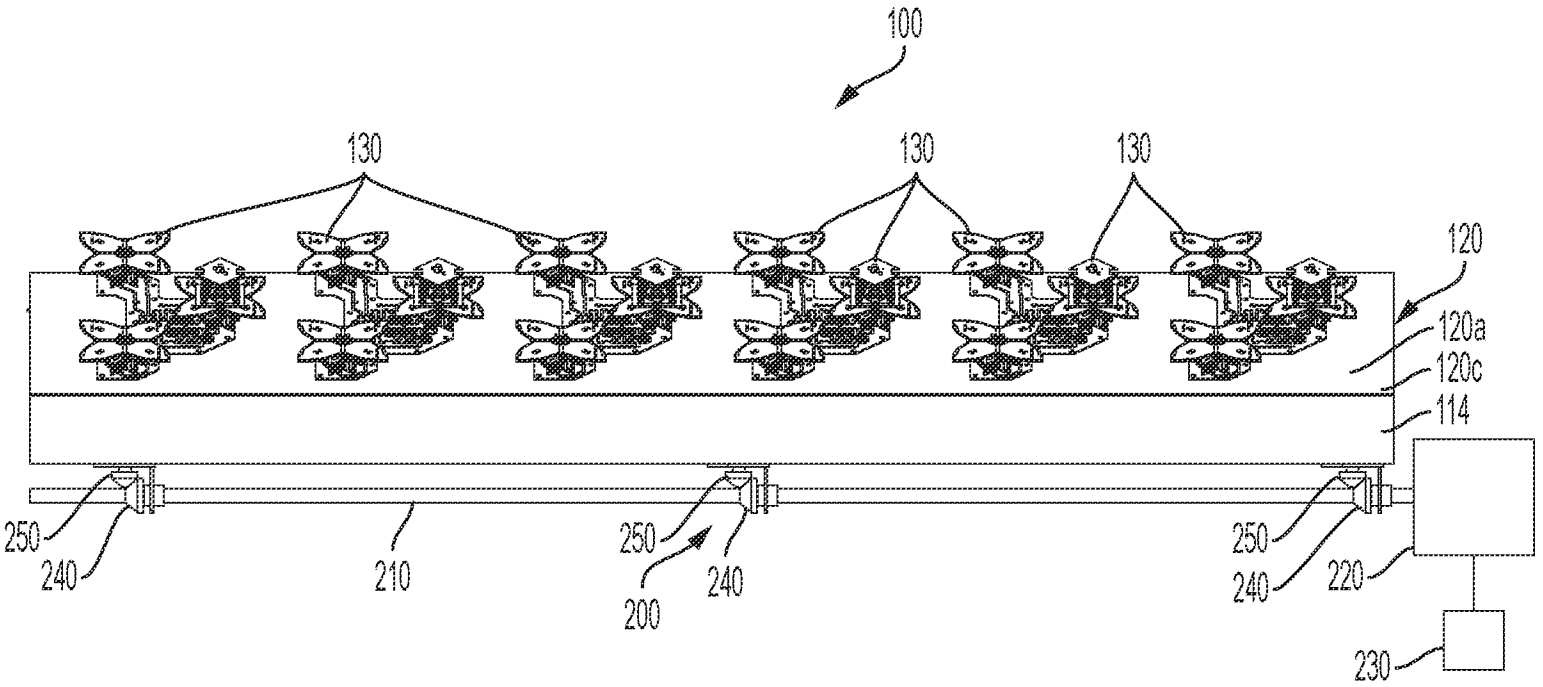
FIG. 2 is a side view of the base station antenna of FIG. 1.

Referring now to the drawings, selected components of a base station antenna 100, according to some embodiments of the present invention, is illustrated. The base station antenna 100 includes a reflector assembly 105 that includes first, second and third reflectors 110, 120, 140. The first and second reflectors 110, 120 are each pivotably attached to respective first and second elongate members 112, 114, which are in spaced-apart relationship. The third reflector 140 is movably coupled to the first and second reflectors 110, 120, and movement of the third reflector causes the first and second reflectors 110, 120 to pivot relative to each other, as will be described below. The base station antenna 100 further includes a drive mechanism 200 that is configured to move the third reflector 140, as will be described below. It will be appreciated that the base station antenna 100 includes many more components that are not shown in the drawings, such as a radome, endcaps, remote electronic tilt mechanisms, filters, controllers, cables, linkages and the like that are not shown in order to simplify the drawings and focus attention on the adjustable reflector mechanisms described herein.

The first, second, and third reflectors 110, 120, 140 each have an elongated rectangular, flat configuration, although other configurations are possible. Each reflector 110, 120, 140 has a respective front or main surface 110*a*, 120*a*, 140*a* and a respective rear or back surface 110*b*, 120*b*, 140*b* and may be constructed from a sheet of metal, such as aluminum. A dense collection of radiating elements 130 extend from the main surface 110*a*, 120*a* of each of the first and second reflectors 110, 120, as illustrated. These radiating elements may include one or more of the following: low-band (LB) radiating elements which operate, for example, in all or part of the 600-960 MHz frequency band, mid-band (MB) radiating elements which operate, for example, in all or part of the 1427-2690 MHz frequency band, and high-band (HB) radiating elements which operate, for example, in all or part of the 3100-4200 and/or 5100-5800 MHz frequency bands. Each reflector 110, 120 acts as an underlying ground plane for the radiating elements 130 and advantageously redirects RF energy that is emitted rearwardly by the radiating elements 130 back in the forward direction. The radiating elements 130 are mounted on feed boards 132 that are used to pass RF signals to and from the radiating elements 130. In the depicted embodiment, three radiating elements are mounted on each feed board 132, and the feed boards 132 are shared across multiple columns of radiating elements 130. It will be appreciated that many other feed board configurations are possible, and that the feed boards 132 may be omitted in some embodiments.

In the illustrated embodiment, the first and second reflectors 110, 120 each include three linear arrays or columns of radiating elements 130. However, embodiments of the present invention are not limited to any particular number of linear arrays or columns of radiating elements 130. Other arrangements and relative placements of radiating elements 130 are possible.

The first reflector 110 is pivotably mounted to the first elongate member 112 along a first edge portion 110*c* of the first reflector 110 via a plurality of spaced apart hinges 150. Similarly, the second reflector 120 is pivotably mounted to the second elongate member 114 along a first edge portion 120*c* of the second reflector 120 via a plurality of spaced apart hinges 150. Each of the illustrated hinges 150 includes first and second members 150*a*, 150*b* that are movable relative to each other via a pin connection, as would be understood by one skilled in the art. However, various types and numbers of hinges may be utilized in accordance with embodiments of the present invention. Embodiments of the present invention are not limited to the illustrated hinge 150 or the illustrated number or arrangement of hinges 150.

Figure 3:
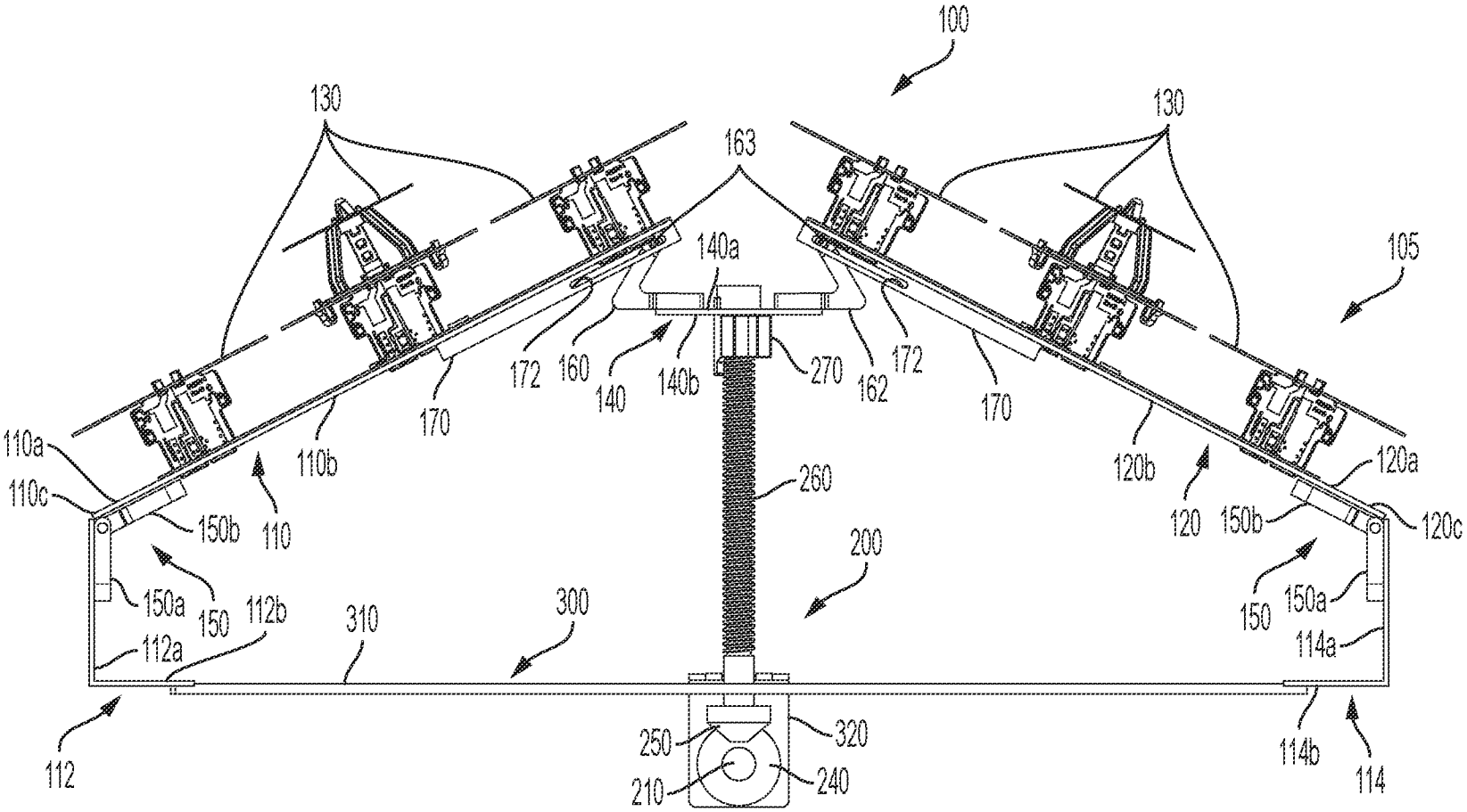
FIG. 3 is a bottom view of the base station antenna of FIG. 1.

In the illustrated embodiment, and with respect to the first reflector 110, the first member 150*a* of each hinge 150 is secured to the first elongate member 112 and the second member 150*b* is secured to the bottom surface 110*b* of the first reflector 110 as shown in FIG. 3. Similarly, with respect to the second reflector 120, the first member 150*a* of each hinge 150 is secured to the second elongate member 114 and the second member 150*b* is secured to the bottom surface 120*b* of the second reflector 120 as shown in FIG. 3. The hinges 150 may be secured to the first and second elongate members 112, 114 and to the first and second reflectors 110, 120 in various ways, such as via fasteners, via welding, via adhesive, etc.

In some embodiments, the first and second elongate members 112, 114 are RF chokes. As will be understood by those skilled in the art, an RF choke is a passive circuit element that allows some currents to pass, but which is designed to block or "choke" other currents in certain frequency bands.

In the illustrated embodiment, each elongate member 112, 114 has an "L" shaped configuration with first and second portions 112*a*, 112*b* oriented generally perpendicular to each other. However, the elongate members 112, 114 can have various shapes and are not limited to the illustrated configuration. In the illustrated embodiment, and with respect to the first elongate member 112, the first member 150*a* of each hinge 150 is secured to the elongate member first portion 112*a* and the first elongate member second portion 112*b* is secured to a portion of a frame 300, which will be described below. Similarly, with respect to the second elongate member 114, the first member 150*a* of each hinge 150 is secured to the second elongate member first portion 114*a* and the second elongate member second portion 114*b* is secured to a portion of the frame 300.

In the illustrated embodiment, the third reflector 140 includes a plurality of spaced apart first arms 160 extending from the third reflector upper surface 140*a*, and a plurality of spaced apart second arms 162 extending from the third reflector upper surface 140*a*. Each of the first arms 160 is in slidable engagement with a guide slot 172 of a respective rail 170 attached to the first reflector 110, and each of the second arms 162 is in slidable engagement with a guide slot 172 of a respective rail 170 attached to the second reflector 120. Embodiments of the present invention are not limited to the illustrated numbers of arms 160, 162. Various numbers may be utilized including a single one of each of the arms 160, 162.

Figure 7:
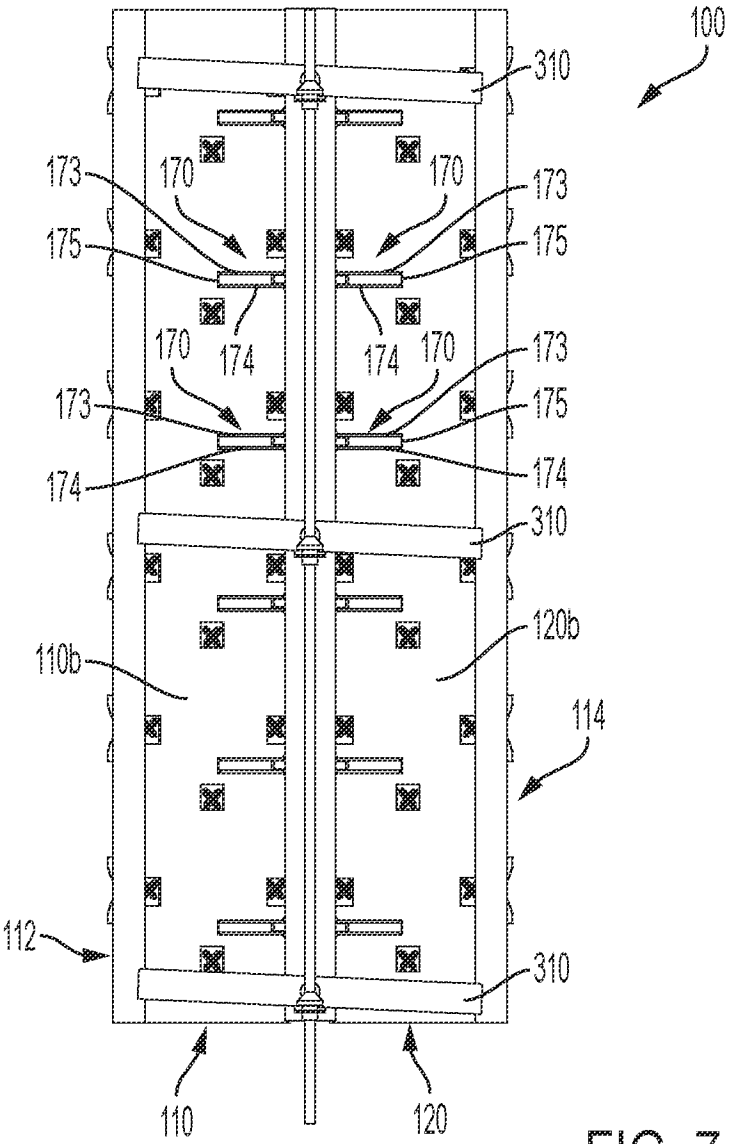
FIG. 7 is a rear view of the base station antenna of FIG. 1.

In the illustrated embodiment, each rail 170 has a generally "U" shaped configuration with opposite first and second walls 173, 174 extending outwardly from a central wall 175, as best shown in FIG. 7. With respect to the first reflector, 110, the central wall 175 of each rail 170 is attached to the back surface 110*b* thereof. With respect to the second reflector 120, the central wall 175 of each rail 170 is attached to the back surface 120*b* thereof. The rails 170 may be attached to the respective first and second reflectors 110, 120 in various ways, such as via fasteners, via welding, via adhesive, etc.

A respective slot 172 is formed in each of the first and second walls 173, 174 and each of the arms 160, 162 are configured such that portions thereof slidably engage the slots 172 of a respective rail 170. In the illustrated embodiment, each arm 160, 162 includes a pair of pins 163 in opposing relationship that are slidably engaged with and movable along the respective two slots 172 in each rail 170. However, embodiments of the present invention are not limited to the illustrated shape and configuration of the first and second arms 160, 162 or the way they engage with the slots 172 of the rails 170. Other shapes and configurations may be utilized, as well as other ways of slidably coupling to the first and second reflectors 110, 120.

For the base station antenna embodiment illustrated in FIGS. 1-7, the rails 170 are attached to the rear surfaces 110*b*, 120*b* of the first and second reflectors 110, 120. However, for the base station antenna embodiment illustrated in FIGS. 9-14, the rails 170 are attached to the front surfaces 110*a*, 120*a* of the first and second reflectors 110, 120 and the radiating elements 130 are attached to the rails 170. Respective slots 176 are formed through each of the first and second reflectors 110, 120 such that a portion of each of the arms 160, 162 can extend therethrough and engage with the slots 172 of a respective rail 170. In the embodiments illustrated in FIGS. 9-14, the rails 170 may be attached to the respective first and second reflectors 110, 120 in various ways, such as via fasteners, via welding, via adhesive, etc. Other than the location of the rails 170 on the main surfaces 110*a*, 120*a* of the first and second reflectors 110, 120, the slots 176 formed within the first and second reflectors 110, 120, and the radiating elements 130 attached to the rails 170, the base station antenna embodiment illustrated in FIGS. 9-14 is identical to that of FIGS. 1-7. While not shown in the drawings, in other embodiments the rails 170 may be omitted and slots may be formed in the reflectors 110, 120 that that receive the pins 163 of arms 160, 162. In such embodiments, the slots in the reflector may be horizontal slots that are between the radiating elements 130.

In some embodiments, the radiating elements 130 may be movable relative to the main surfaces 110*a*, 120*a* of the first and second reflectors 110, 120 during pivotal movement of the first and second reflectors 110, 120. This may be accomplished, for example, by mounting the feed boards 132 for the radiating elements 130 on the arms 160, 162. As the arms 160, 162 move in the slots 172, the feed boards 132 on which the radiating elements 130 are mounted move laterally along the respective front surfaces of the reflectors 110, 120.

Figure 4:
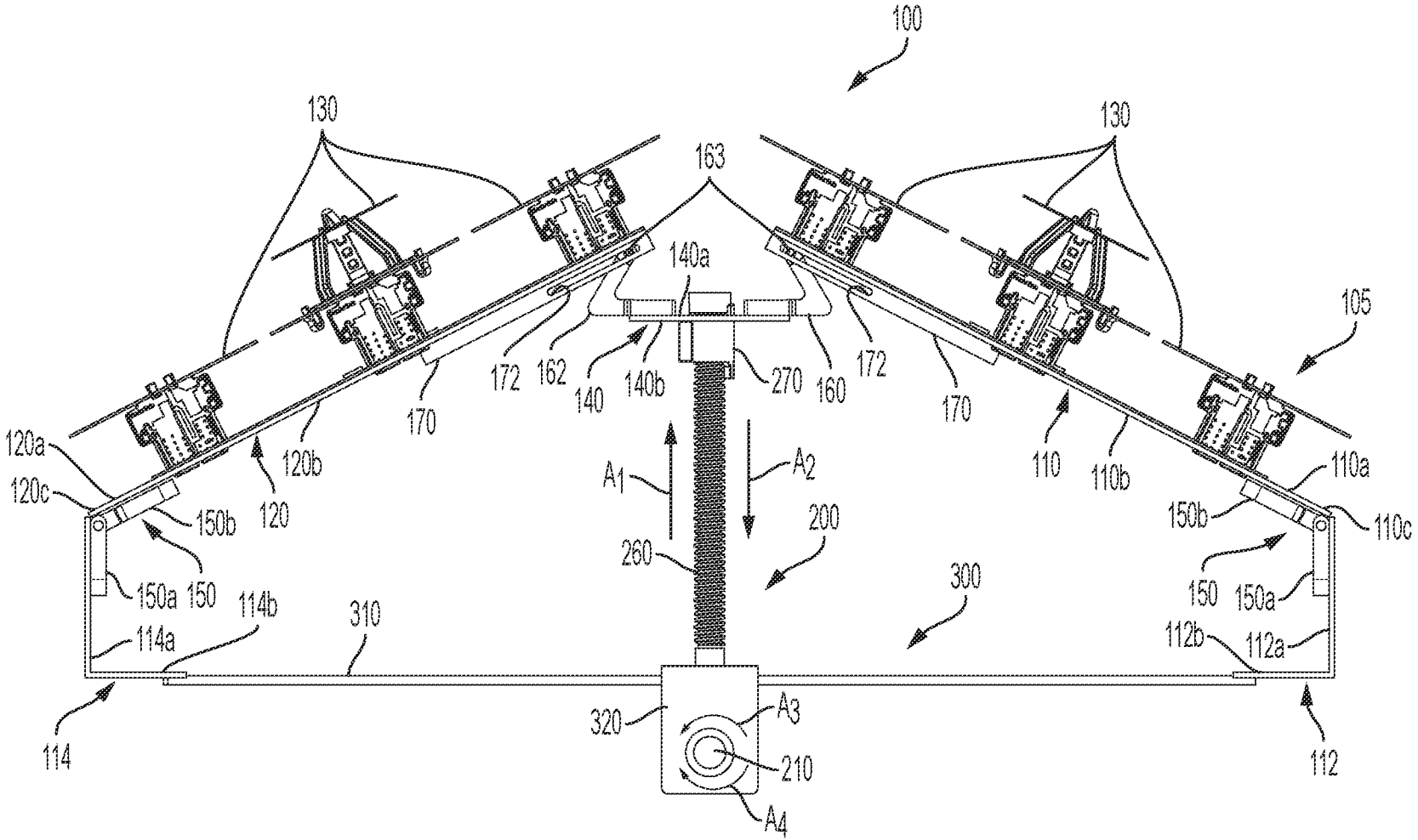
FIG. 4 is a top view of the base station antenna of FIG. 1.
Figure 5:
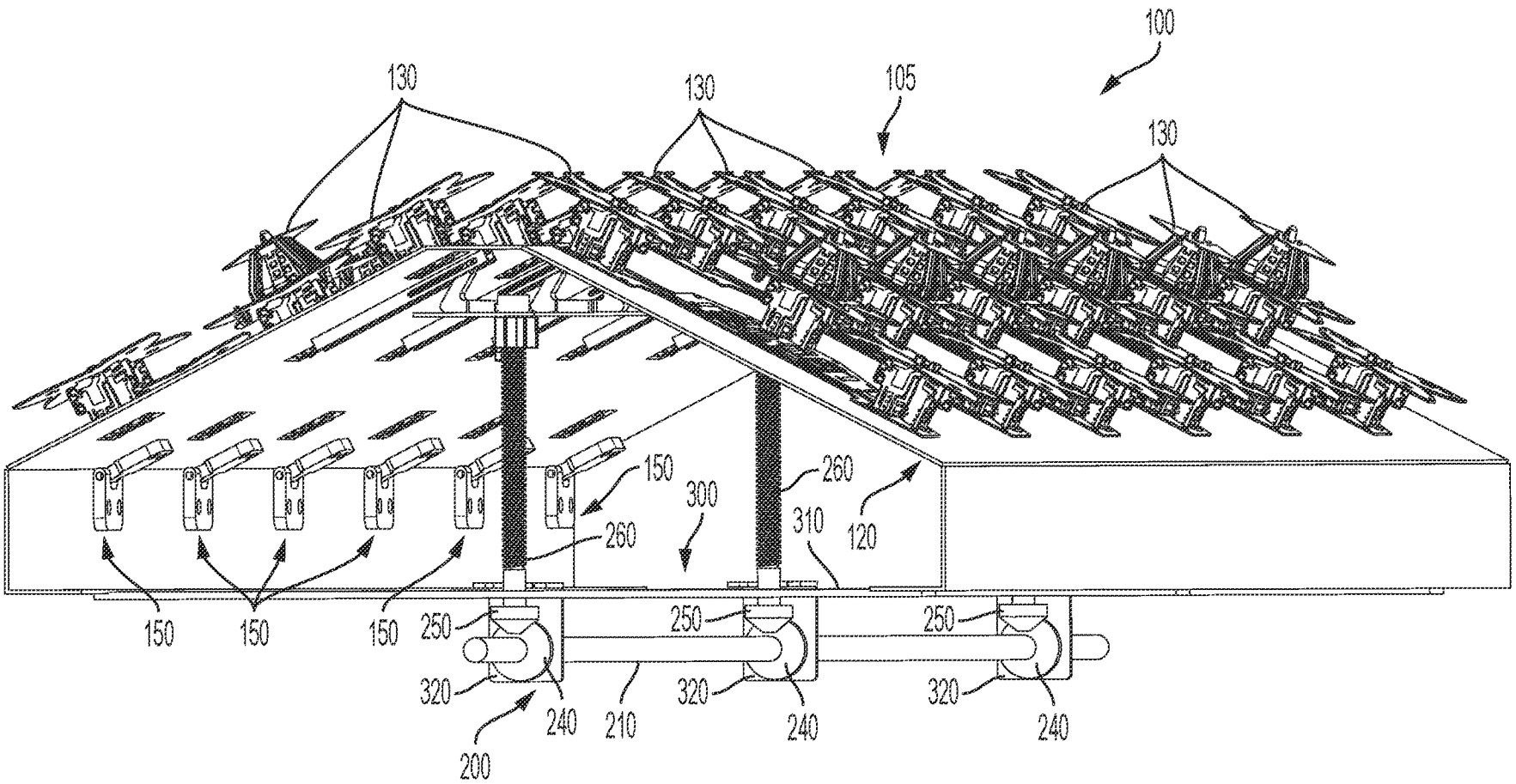
FIGS. 5-6 are additional top perspective views of the base station antenna of FIG. 1.
Figure 6:
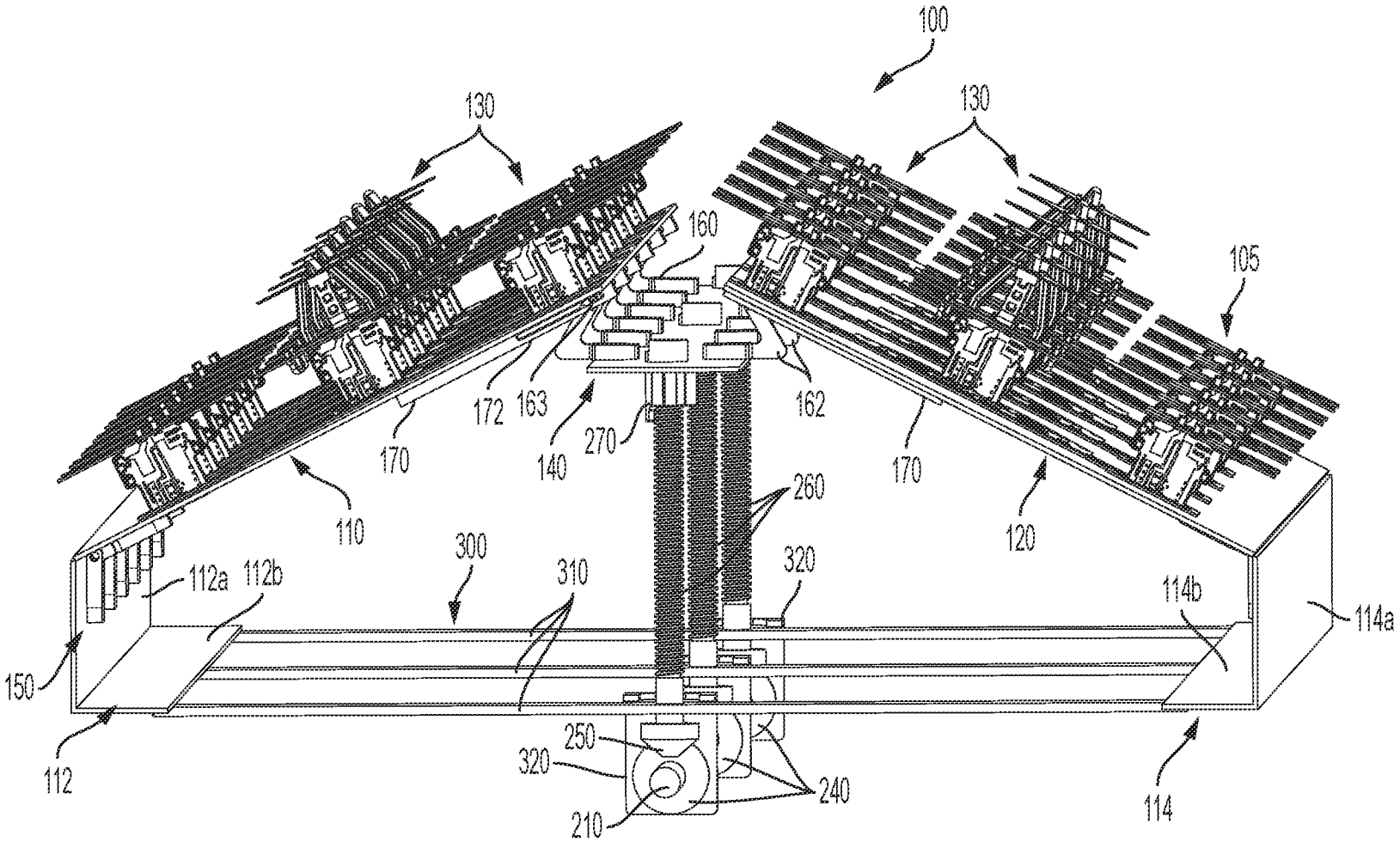
Figure 8A:
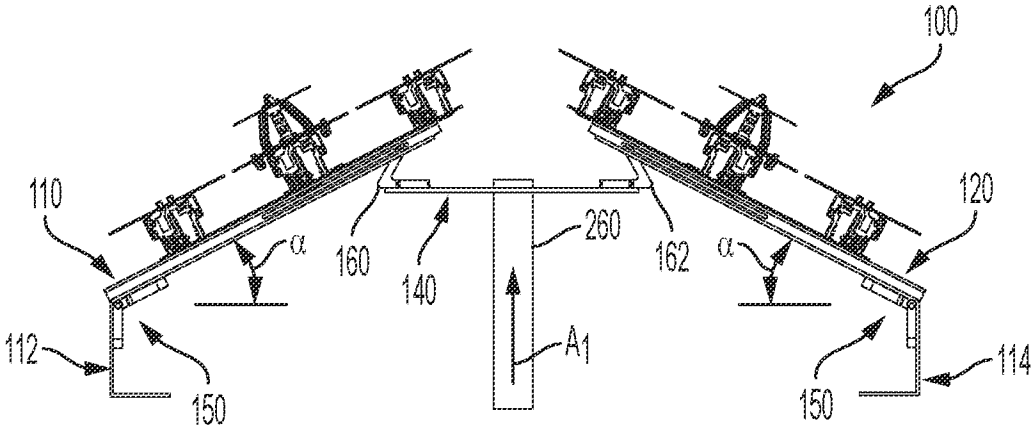
FIGS. 8A-8B illustrate linear movement of a third reflector of the base station antenna of FIG. 1 along directions A1 and A2 and the resulting movement of the first and second reflectors.
Figure 8B:
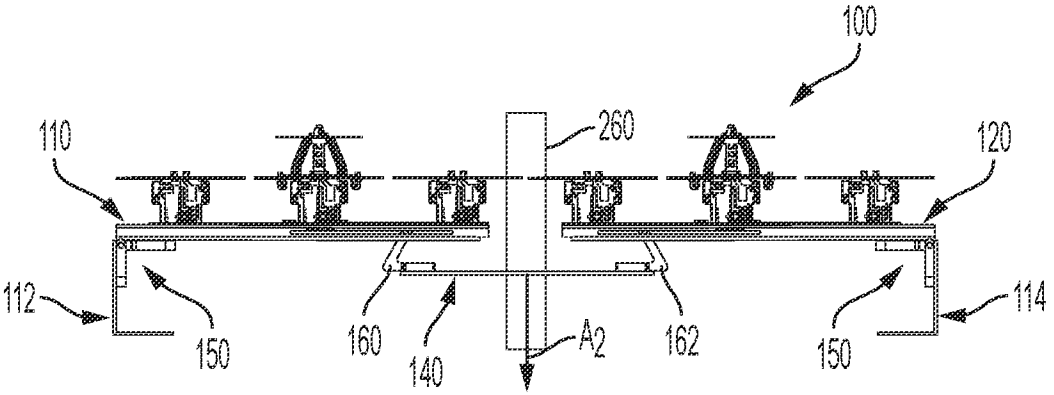
Figure 9:
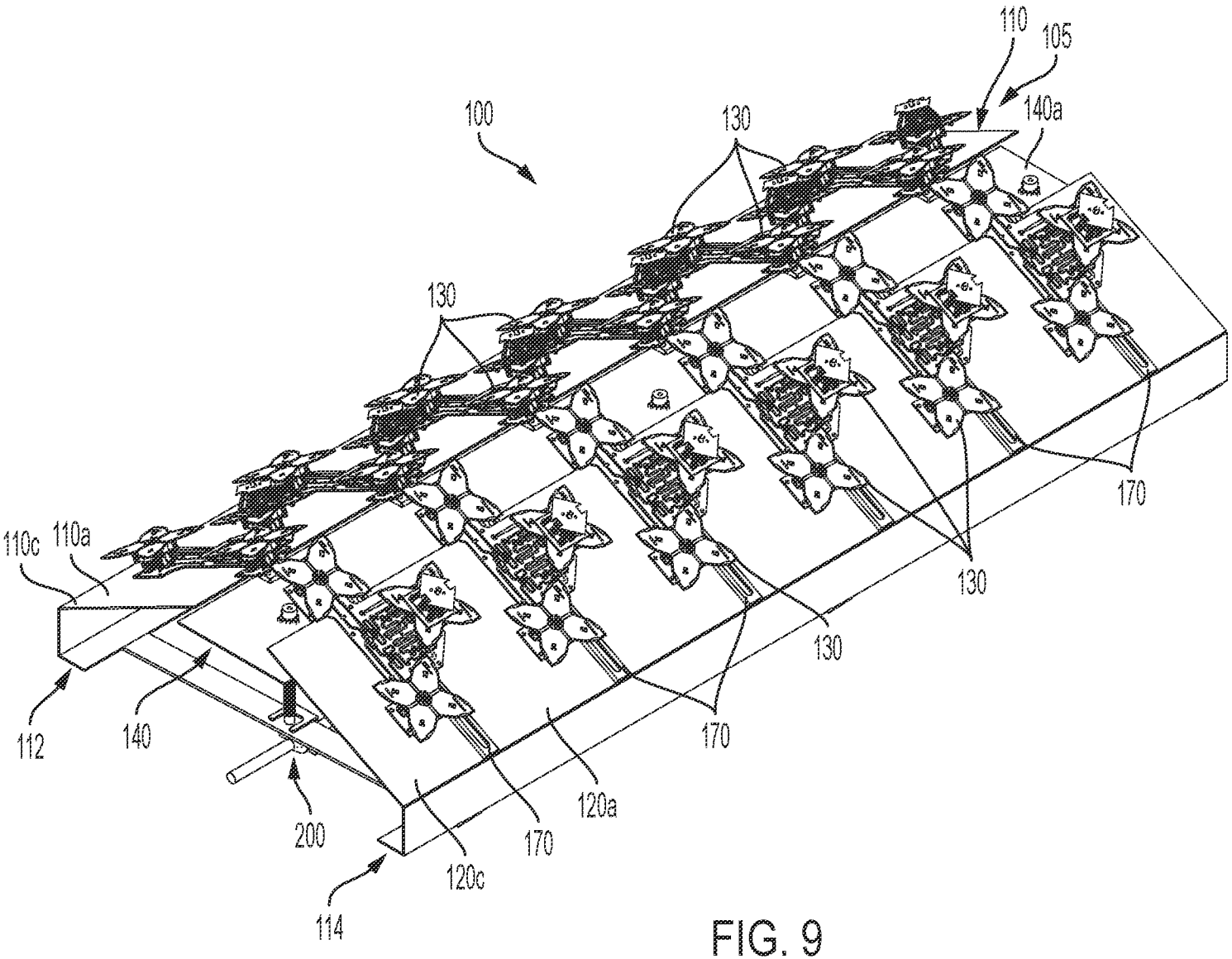
FIG. 9 is a schematic front perspective view of selected components of a base station antenna according to other embodiments of the present invention.
Figure 10:
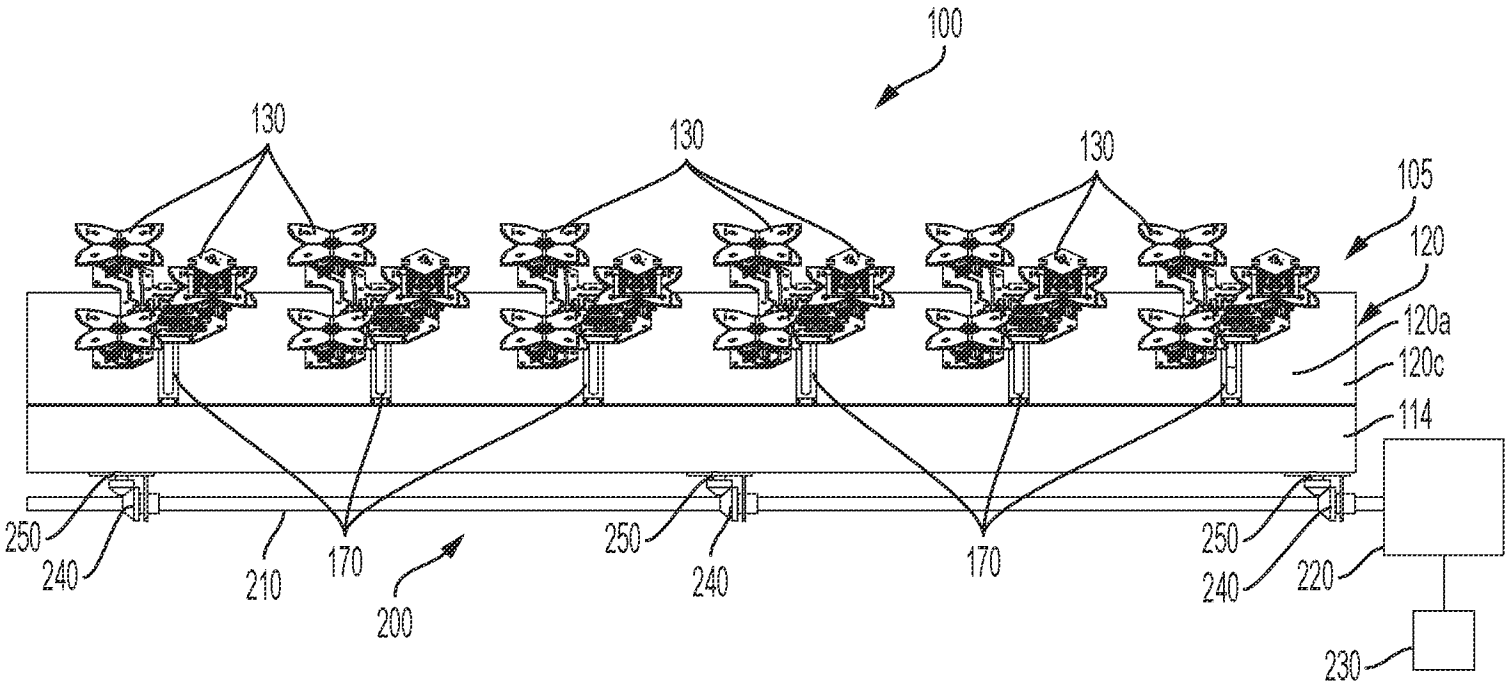
FIG. 10 is a side view of the base station antenna of FIG. 9.
Figure 11:
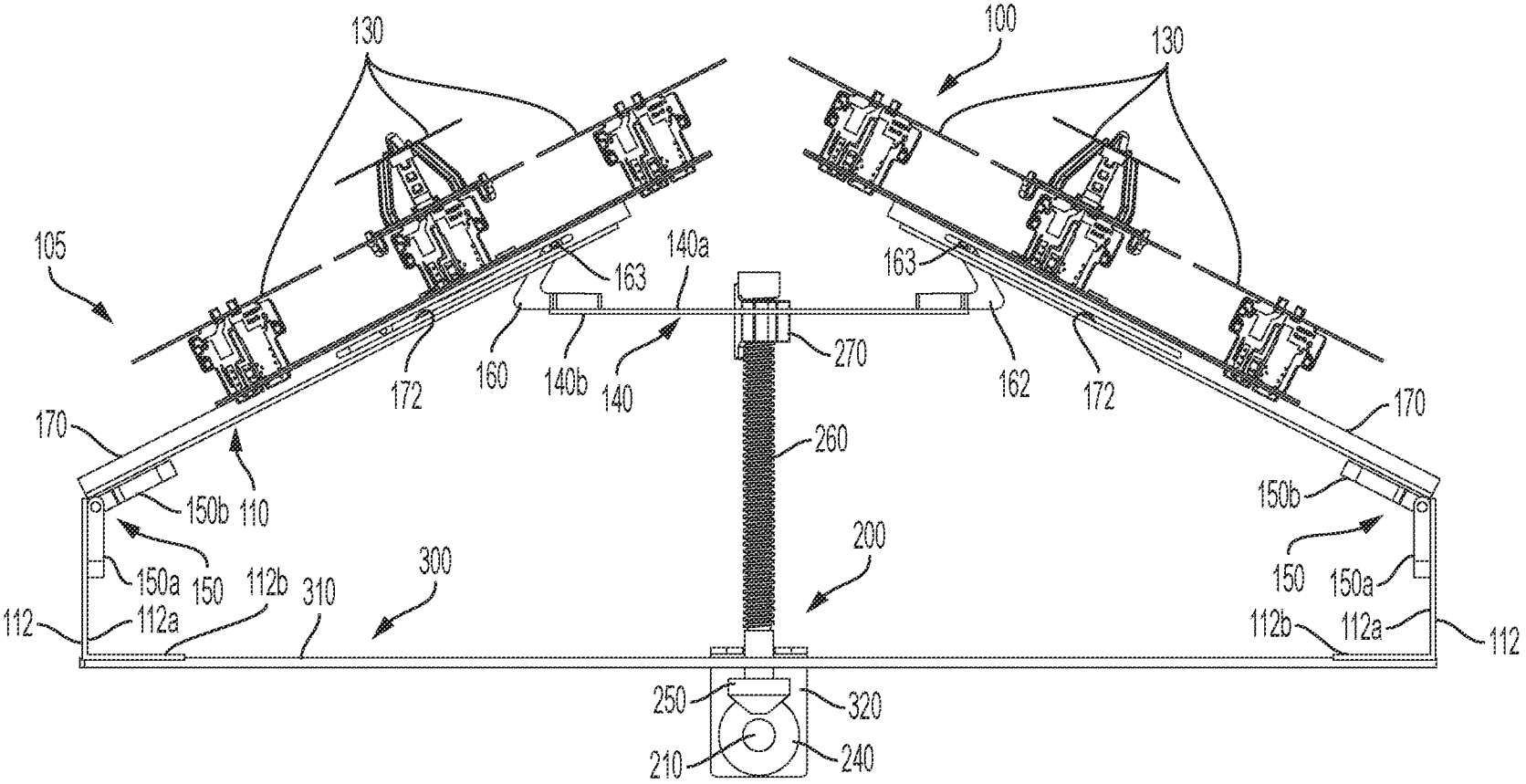
FIG. 11 is a bottom view of the base station antenna of FIG. 9.
Figure 12:
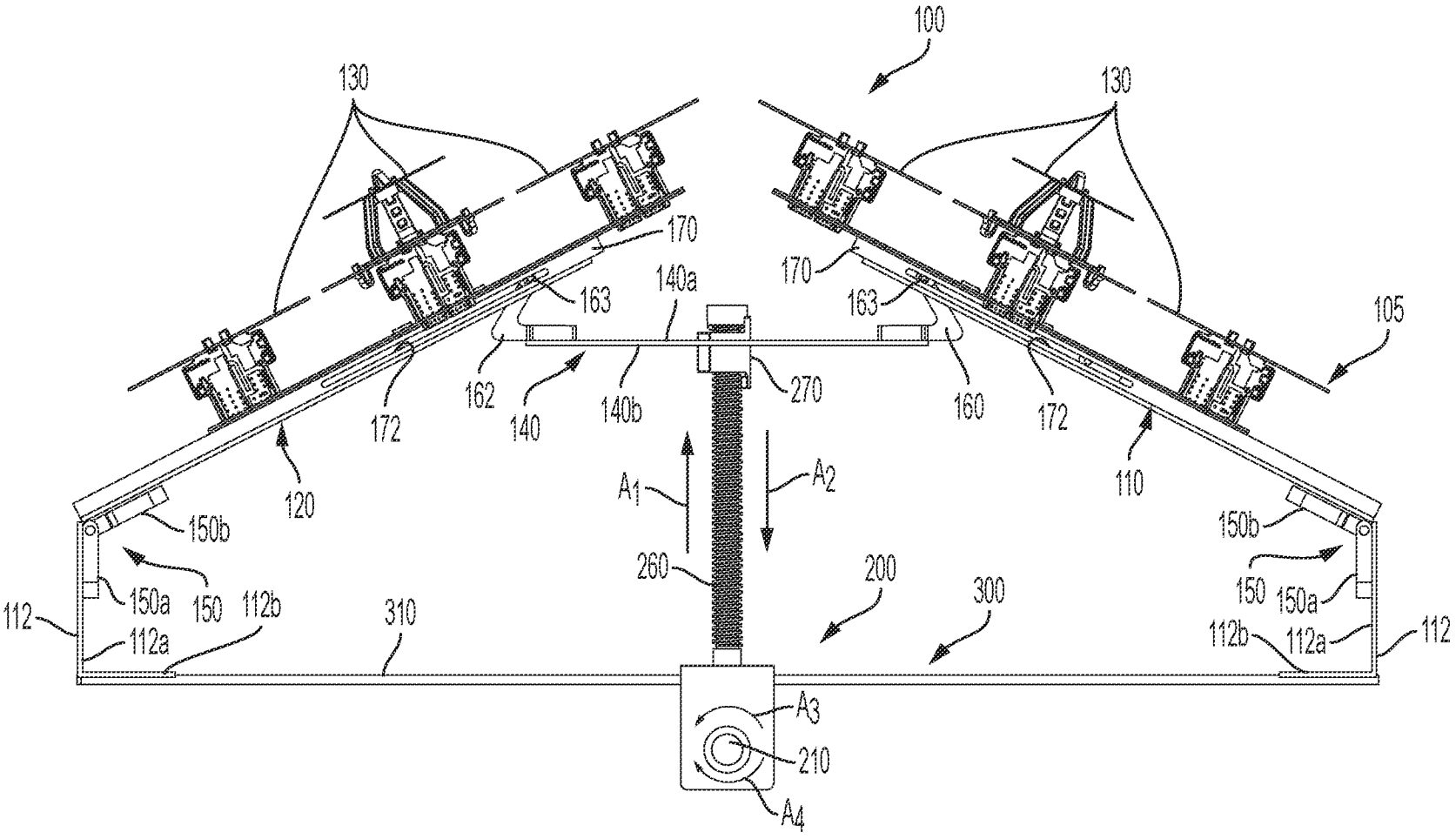
FIG. 12 is a top view of the base station antenna of FIG. 9.
Figure 13:
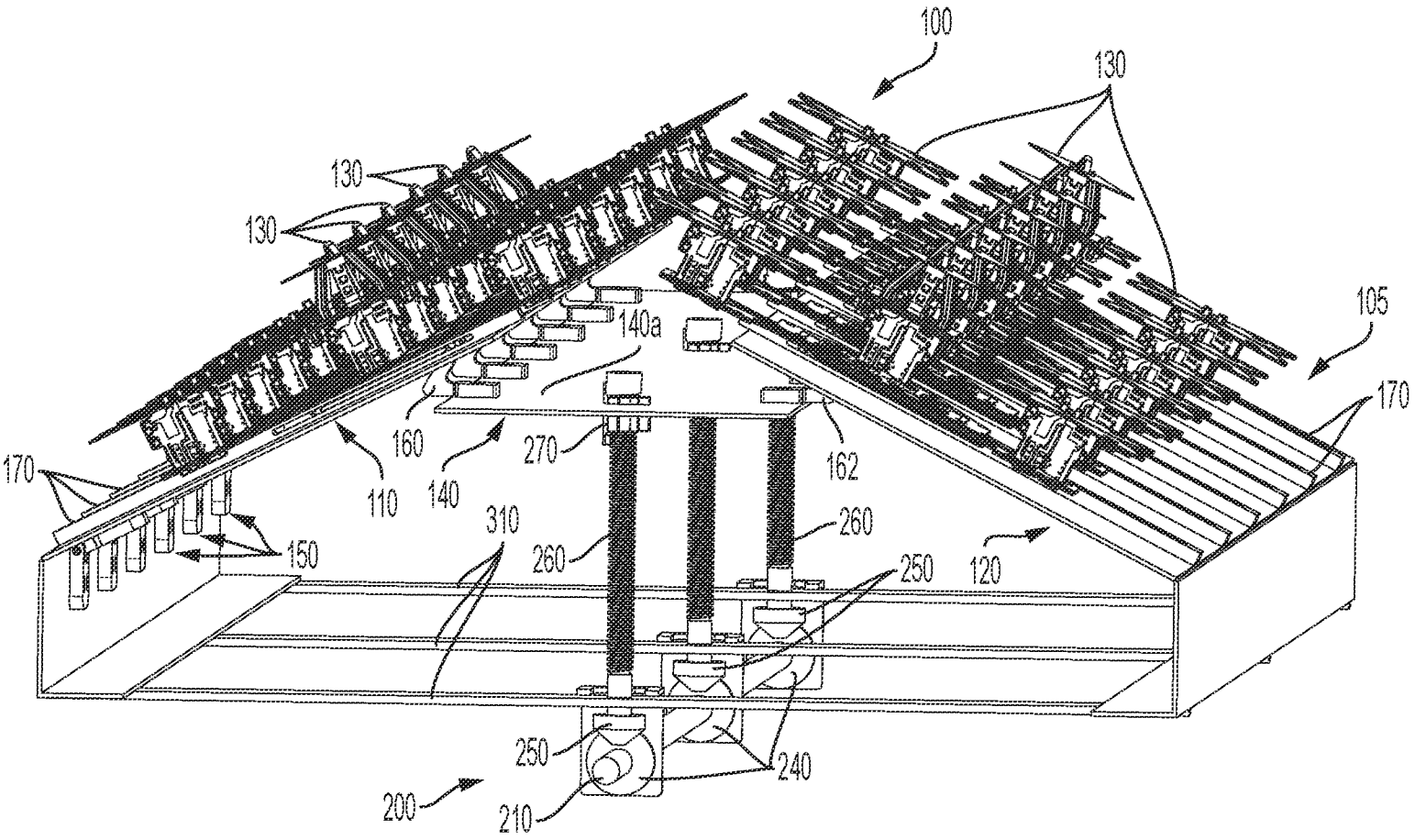
FIGS. 13-14 are additional perspective views of the base station antenna of FIG. 9.
Figure 14:
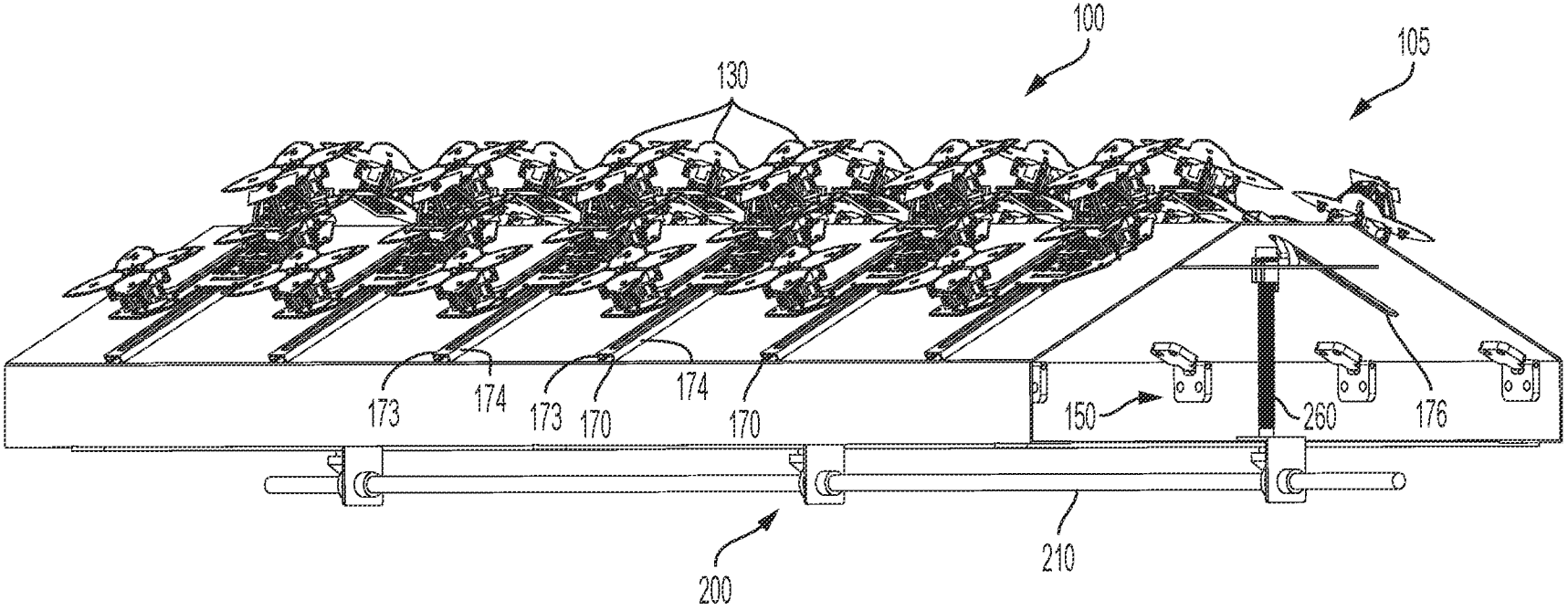

A drive mechanism 200 is configured to move the third reflector 140 in the linear directions indicated by arrows A1 and A2 in FIG. 4. Movement of the third reflector 140 in the directions A1, A2 causes pivotal movement of the first and second reflectors 110, 120 as a result of the slidable engagement of the arms 160, 162 with the respective rails 170 attached to the first and second reflectors 110, 120. FIGS. 8A-8B illustrate the linear movement of the third reflector 140 along directions A1 and A2 and the resulting pivotal movement of the first and second reflectors 110, 120. In some embodiments, a pivot angle α (FIG. 8A) for each of the first and second reflectors 110, 120 can be between 0°-75°. In some embodiments, the first and second reflectors 110, 120 are pre-set in the field at an angle of about 60° relative to each other, and this angle is then adjusted ±10° as needed. For example, the angle of reflectors 110, 120 may be adjusted so that they are generally coplanar, which results in a base station antenna having six columns of radiating elements 130 mounted on a flat reflector. Such an antenna may be desirable for certain applications. The base station antenna can also be adjusted to have the reflectors 110, 120 each tilted away from each other by, for example, an angle of about 30° (so that the reflectors 110, 120 define an angle of about 60°) and used for twin beam applications. Additionally, different customers may desire twin beam antennas having reflector panels that form different angles. For example, some customers may require each reflector panel be bent from the horizontal by about 25°, while other customers may require that the reflector panels be bent by as much as 33°. The base station antennas according to embodiments of the present invention may be used to satisfy any such customer requirements due to the adjustability in the amount that the reflector is bent.

The illustrated drive mechanism 200 includes a drive shaft 210, an actuator 220 (FIG. 2), such as an electric motor, that is configured to rotate the drive shaft 210, and a control unit 230 (FIG. 2) that is configured to control the actuator 220. In some embodiments, the control unit may be a remote electrical tilt (RET) controller utilized by the base station antenna 100. A plurality of gears 240, such as bevel gears, are positioned along the drive shaft 210, as illustrated. Each of these gears 240 mesh with respective gears 250, such as bevel gears, connected to the ends of respective threaded shafts 260 which are configured to rotate in response to rotation of the drive shaft 210. Various types of gears may be utilized to transfer rotational movement of the driveshaft 210 to the threaded shafts 260. Embodiments of the present invention are not limited to a particular gear configuration or to the illustrated gear configuration. Each threaded shaft 260 is threadably coupled to the third reflector 140 such that rotational movement of the threaded shafts 260 causes linear movement of the third reflector 140 in either direction A1 or A2, depending on the axial rotation direction of the drive shaft 210 (i.e., A3 or A4, FIG. 4). The pivotal movement of the first and second reflectors 110, 120 as a result of the linear movement of the third reflector in directions A1 or A2 (as a result of axial rotation of the drive shaft 210 in directions A3 or A4) is illustrated in FIGS. 8A-8B. In the illustrated embodiment, the third reflector 140 includes a plurality of threaded members 270 such as nuts that are configured to threadably engage the threaded shafts 260. The threaded members 270 are configured to move along the respective threaded shafts 260 during rotation thereof, as would be understood by one skilled in the art. Moreover, while in the depicted embodiment an actuator is used to adjust the angular positions of the reflectors 110, 120, it will be appreciated that in other embodiments the base station antenna may additionally or alternatively be configured so that a technician can adjust the angular positions of the reflectors 110, 120 by hand.

The illustrated driving mechanism 200 is supported by a frame 300 that is secured to and extends between the first and second elongate members 112, 114. The illustrated frame 300 includes a plurality of spaced-apart cross members 310 that are secured to the first and second elongate members 112, 114, and each of these cross members 310 includes a bracket 320 that is configured to support the drive shaft 210 and allow rotation thereof. The cross members 310 may be attached to the respective first and second elongate members 112, 114 in various ways, such as via fasteners, via welding, via adhesive, etc. The brackets 320 may be secured to the cross members 310 in various ways, such as via fasteners, via welding, via adhesive, etc.

Figure 15:
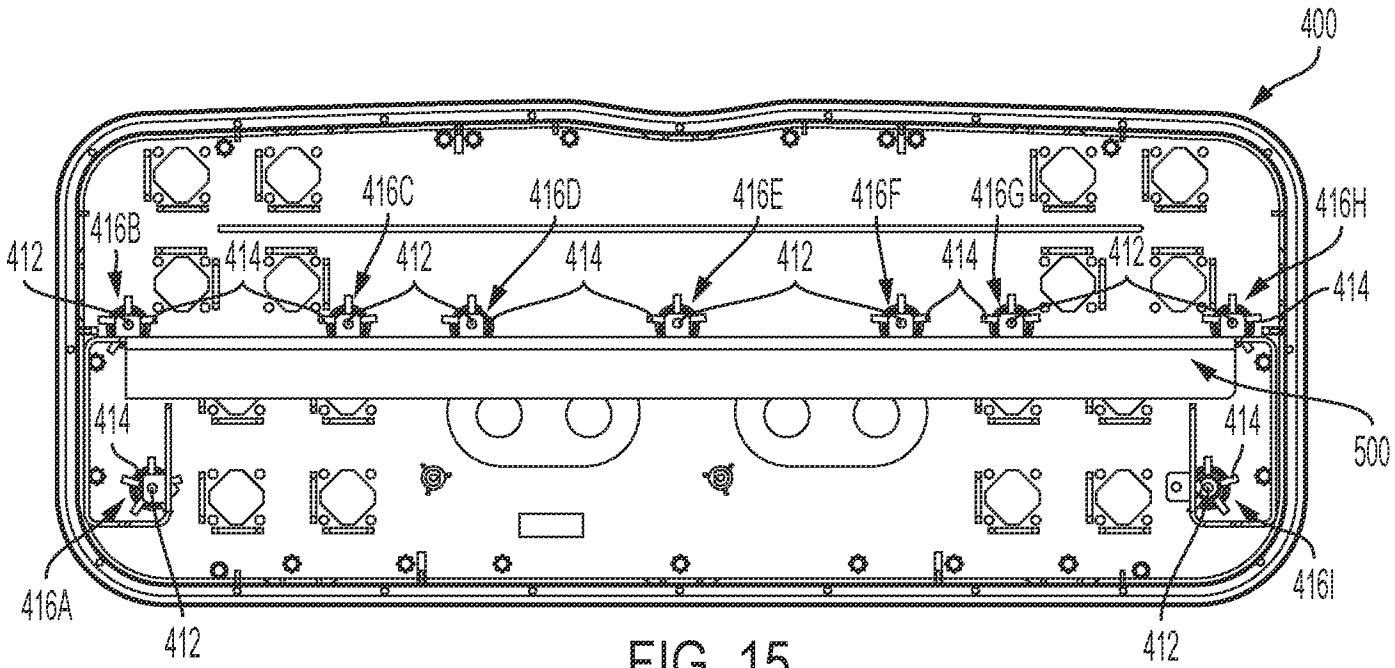
FIG. 15 PRIOR ART
FIGS. 15-16 illustrate a prior art base station antenna endcap and its connection to a reflector of a base station antenna.
Figure 16:
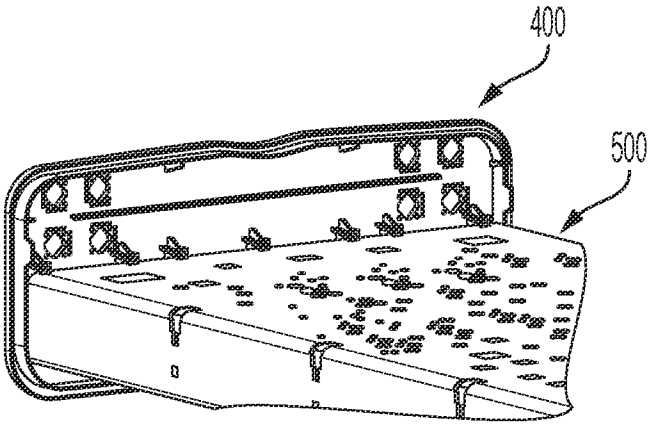
FIG. 16 PRIOR ART
Figure 21:
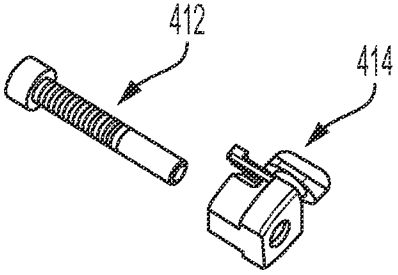
FIG. 21 is an exploded view of a threaded member and mount for securing the reflector of FIG. 19 to the base station antenna endcap of FIG. 17.

Referring to FIGS. 15 and 16, a conventional endcap 400 for a base station antenna (not shown) is illustrated. The endcap 400 is secured to a reflector 500 of the base station antenna using threaded members 412 (FIG. 21) and endcap mounts 414 (FIG. 21) at nine locations 416A-416I.

Referring to FIGS. 17-20, an endcap 600 for a base station antenna according to some embodiments of the present invention is illustrated. The illustrated endcap 600 includes a plurality of support members 610 extending from the interior face 600*a* of the endcap 600 in spaced-apart relationship. The support members 610 have a hook-type configuration with a distal end portion configured to be inserted within or otherwise engage respective cutouts or slots 710 (FIG. 19) within a reflector 700. To secure the reflector 700 to the endcap 600, the support members 610 align with and engage the reflector cutouts 710, and then the remaining degrees of freedom of the reflector are arrested using a threaded member 412 and corresponding threaded endcap mount 414 at two locations. This design reduces the number of threaded members 412 and endcap mounts 414 from nine to two. As a result, the number of endcap mounting parts is reduced, thereby reducing the assembly time and cost required for securing the reflector 700 to the endcap 600.

Figure 17:
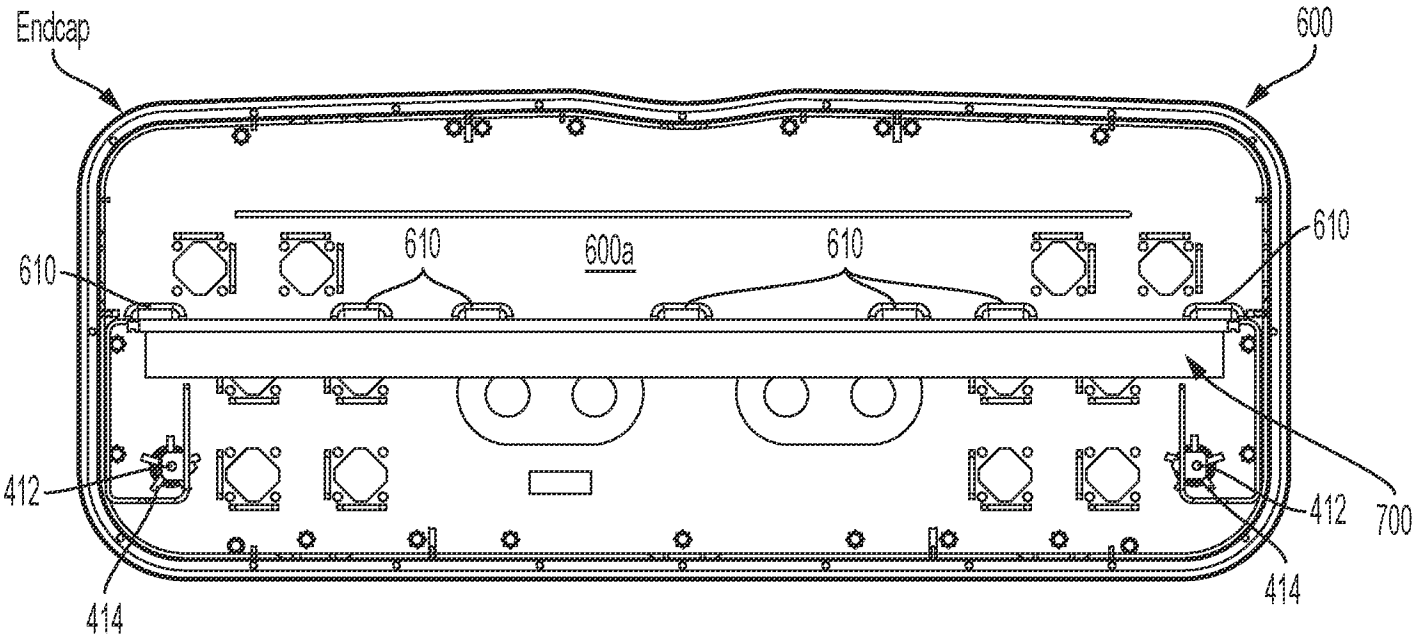
FIG. 17 is a plan view of a base station antenna endcap according to some embodiments of the present invention.
Figure 18:
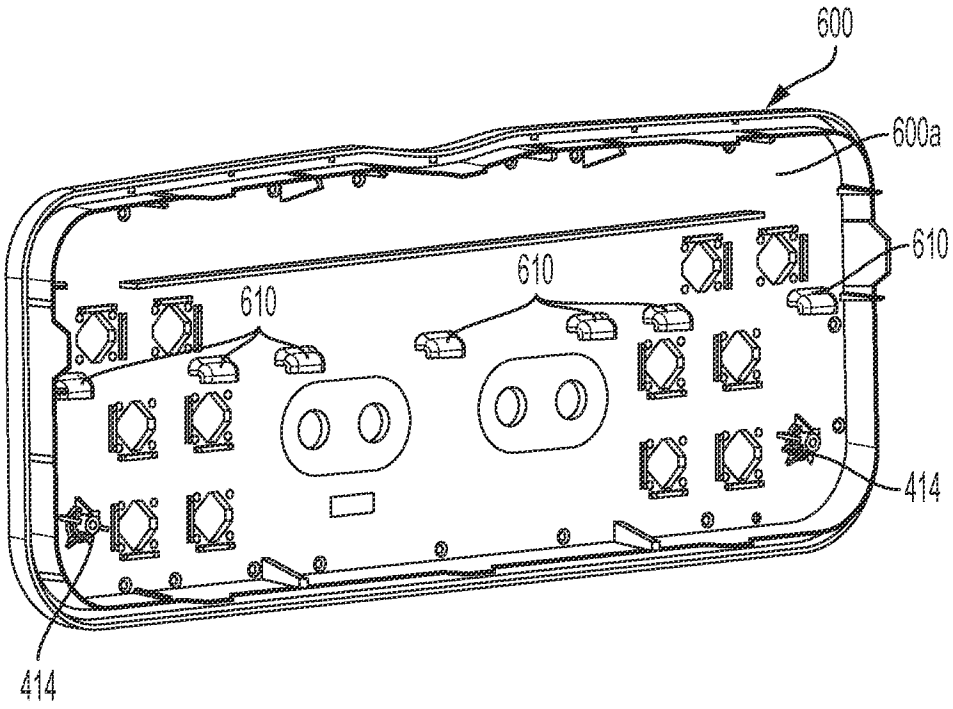
FIG. 18 is a perspective view of the base station antenna endcap of FIG. 17.
Figure 19:
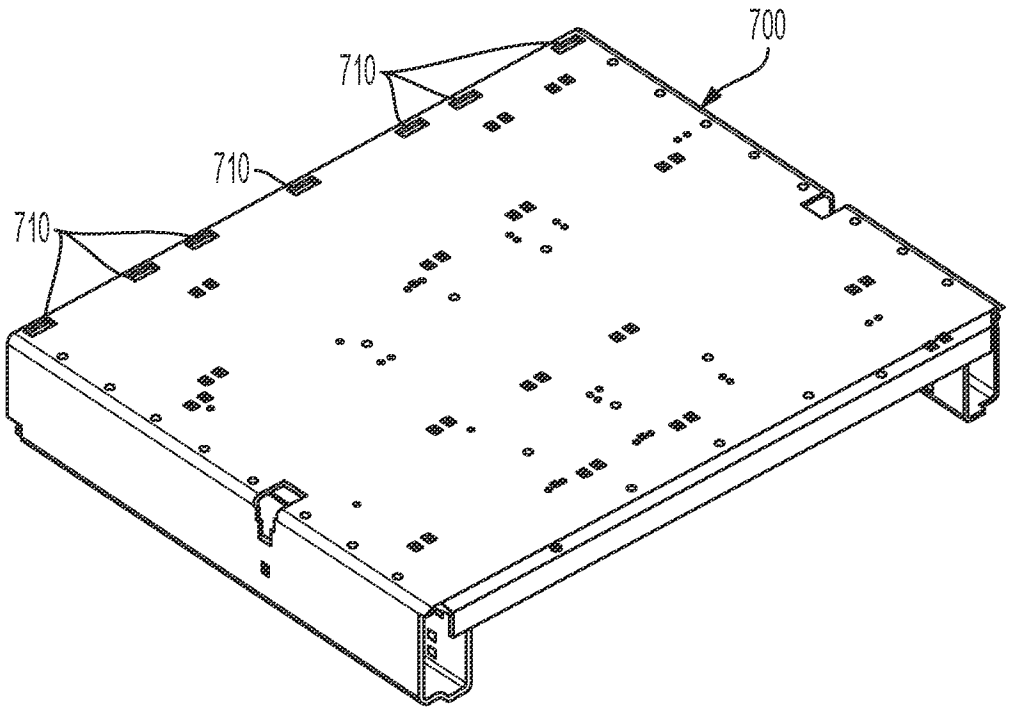
FIG. 19 is a front perspective view of a reflector configured to be secured to the base station antenna endcap of FIG. 17, according to some embodiments of the present invention.
Figure 20:
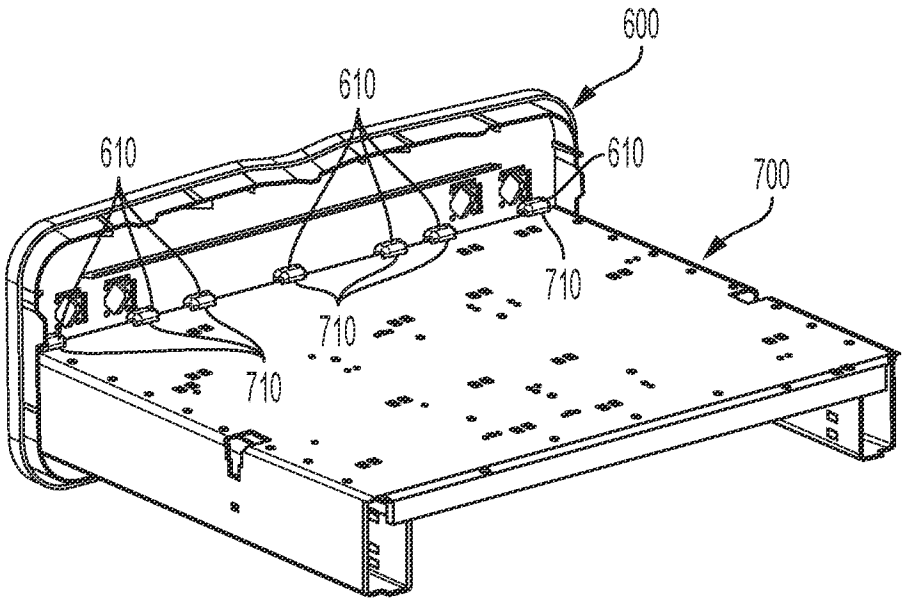
FIG. 20 is a perspective view of the base station antenna endcap of FIG. 17 with the reflector of FIG. 19 attached thereto.

The support members 610 may be integrally molded with the endcap 600 in some embodiments. In addition, the support members 610 may have other shapes and configurations. Embodiments of the present invention are not limited to the shape, number, or configuration of the illustrated support members 610. For example, in other embodiments, the support members 610 may be oriented such that they engage cutouts in a reflector from the back surface of the reflector 700 instead of the front, main surface, as illustrated in FIGS. 17 and 20.

Various numbers of support members 610 may be utilized with an endcap, according to embodiments of the present invention. Although seven support members 610 are illustrated, embodiments of the present invention are not limited to seven support members 610. For example, in other embodiments at least three support members 610 or at least five support members 610 are utilized.

Embodiments of the present invention have been described above with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element is referred to as being "on" another element, it can be directly on the other element or intervening elements may also be present. In contrast, when an element is referred to as being "directly on" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (i.e., "between" versus "directly between", "adjacent" versus "directly adjacent", etc.).

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, operations, elements, and/or components, but do not preclude the presence or addition of one or more other features, operations, elements, components, and/or groups thereof.

Aspects and elements of all of the embodiments disclosed above can be combined in any way and/or combination with aspects or elements of other embodiments to provide a plurality of additional embodiments.

That which is claimed is:

1. A base station antenna, comprising:

first and second reflectors that are movable relative to each other, each of the first and second reflectors comprising a plurality of radiating elements on a main reflector surface thereof;

a third reflector movably coupled to the first and second reflectors, wherein movement of the third reflector causes opposing pivotal movement of the first and second reflectors; and a drive mechanism configured to move the third reflector.

2. The base station antenna of claim 1, wherein the drive mechanism comprises:

a drive shaft;

an actuator configured to rotate the drive shaft;

a threaded shaft coupled to the drive shaft and configured to rotate in response to rotation of the drive shaft, wherein the threaded shaft is threadably coupled to the third reflector such that rotational movement of the threaded shaft causes movement of the third reflector; and a control unit configured to control the actuator.

3. The base station antenna of claim 2, wherein the control unit comprises a remote electrical tilt (RET) controller.

4. The base station antenna of claim 2, wherein the third reflector comprises a threaded nut that engages the threaded shaft, the threaded nut configured to move along the threaded shaft during rotation of the threaded shaft.

5. The base station antenna of claim 1, wherein the plurality of radiating elements comprise at least one column of radiating elements.

6. The base station antenna of claim 5, wherein the at least one column of radiating elements comprises three columns of radiating elements, and wherein at least one of the three columns of radiating elements is staggered with respect to another one of the three columns of radiating elements.

7. The base station antenna of claim 1, wherein the plurality of radiating elements on the main reflector surface of the first reflector comprise at least one column of radiating elements, and wherein the plurality of radiating elements on the main reflector surface of the second reflector comprise at least one column of radiating elements.

8. A base station antenna, comprising:

a reflector assembly, comprising:

first and second reflectors that are movable relative to each other, each of the first and second reflectors comprising a plurality of radiating elements on a main reflector surface thereof;

a pair of first and second elongate members in spaced-apart relationship, wherein the first reflector is pivotably mounted to the first elongate member along a first edge portion of the first reflector, and wherein the second reflector is pivotably mounted to the second elongate member along a first edge portion of the second reflector; and a third reflector located proximate to the first and second reflectors, wherein the third reflector comprises a first arm in slidable engagement with a first guide slot associated with the first reflector and a second arm in slidable engagement with a second guide slot associated with the second reflector; and a drive mechanism configured to move the third reflector such that the first and second arms move along the respective first and second guide slots to cause pivotal movement of the first and second reflectors.

9. The base station antenna of claim 8, wherein the drive mechanism comprises:

a drive shaft;

an actuator configured to rotate the drive shaft;

a threaded shaft coupled to the drive shaft and configured to rotate in response to rotation of the drive shaft, wherein the threaded shaft is threadably coupled to the third reflector such that rotational movement of the threaded shaft causes movement of the third reflector; and a control unit configured to control the actuator.

10. The base station antenna of claim 9, further comprising a frame secured to and extending between the first and second elongate members, and wherein the drive shaft is supported by the frame.

11. The base station antenna of claim 9, wherein the control unit comprises a remote electrical tilt (RET) controller.

12. A base station antenna, comprising:

a reflector assembly, comprising:

a pair of first and second elongate RF chokes in spaced-apart relationship;

a first reflector pivotably mounted to the first elongate RF choke along a first edge portion of the first reflector, the first reflector comprising a plurality of radiating elements on a main reflector surface thereof;

a second reflector pivotably mounted to the second elongate RF choke along a first edge portion of the second reflector, the second reflector comprising a plurality of radiating elements on a main reflector surface thereof; and a third reflector movably coupled to the first and second reflectors, wherein movement of the third reflector causes the first and second reflectors to move relative to each other; and a drive mechanism configured to move the third reflector.

13. The base station antenna of claim 12, wherein the third reflector comprises a first a arm in slidable engagement with a guides lot of a first rail attached to the first reflector and a second arm in slidable engagement with a guide slot of a second rail attached to the second reflector, and wherein the drive mechanism is configured to move the third reflector such that the first and second arms move a long the respective guide slots of the first and second rails to cause pivotal movement of the first and second reflectors.

14. The base station antenna of claim 13, wherein the first and second rails are attached to the main reflector surface of the first and second reflectors.

15. The base station antenna of claim 13, wherein the first and second rails are attached to a rear surface of the first and second reflectors.

16. The base station antenna of claim 14, wherein the drive mechanism comprises:

a drive shaft;

an actuator configured to rotate the drive shaft;

a threaded shaft coupled to the drive shaft and configured to rotate in response to rotation of the drive shaft, wherein the threaded shaft is threadably coupled to the third reflector such that rotational movement of the threaded shaft causes movement of the third reflector; and a control unit configured to control the actuator.

17. The base station antenna of claim 16, further comprising a frame secured to and extending between the first and second elongate RF chokes, and wherein the drive shaft is supported by the frame.

18. The base station antenna of claim 16, wherein the control unit comprises a remote electrical tilt (RET) controller.

19. The base station antenna of claim 16, wherein the third reflector comprises a threaded nut that engages the threaded shaft, the threaded nut configured to move along the threaded shaft during rotation of the threaded shaft.

* * * * *